United States Patent [19]

Bonello et al.

[11] Patent Number: 4,856,721

[45] Date of Patent: Aug. 15, 1989

[54] WINDING DEVICE

[75] Inventors: Philippe Bonello, Grand-Saconnex, Switzerland; Jacques Noirot, Annemasse, France

[73] Assignee: Sarcem S.A., Meyrin, Switzerland

[21] Appl. No.: 881,361

[22] PCT Filed: Oct. 18, 1985

[86] PCT No.: PCT/CH85/00156

§ 371 Date: Aug. 12, 1986

§ 102(e) Date: Aug. 12, 1986

[87] PCT Pub. No.: WO86/02485

PCT Pub. Date: Apr. 24, 1986

[30] Foreign Application Priority Data

Oct. 18, 1984 [CH] Switzerland ..... 5077/84

[51] Int. Cl.[4] ..... H01F 41/06

[52] U.S. Cl. ..... 242/7.14

[58] Field of Search ..... 242/7.01, 7.06, 7.07, 242/7.14; 57/3, 9, 10, 11

[56] References Cited

U.S. PATENT DOCUMENTS

| | | | |
|---|---|---|---|
| 391,908 | 10/1888 | Murphy | 57/11 |
| 412,880 | 10/1889 | Everson | 57/3 |
| 1,382,502 | 6/1921 | Green | 57/10 |
| 1,392,611 | 10/1921 | Adams | 57/10 |
| 1,412,747 | 4/1922 | Hull | 242/7.01 X |
| 2,730,474 | 1/1956 | Finholt et al. | 242/7.06 X |
| 2,765,124 | 10/1956 | Sickles | 242/7.09 |
| 3,142,450 | 7/1964 | Bohannon, Jr. | 242/7.01 |
| 3,291,403 | 12/1966 | Montgomery | 242/7.01 X |
| 3,445,072 | 5/1969 | Koppisch | 57/11 X |
| 3,793,816 | 2/1974 | Kodama | 57/3 X |
| 3,837,152 | 9/1974 | Dakhov et al. | 57/9 |

FOREIGN PATENT DOCUMENTS

| | | |
|---|---|---|
| 793577 | 4/1973 | Belgium . |
| 1090742 | 10/1960 | Fed. Rep. of Germany . |
| 57-190309 | 11/1982 | Japan . |
| 58-132913 | 8/1983 | Japan . |

*Primary Examiner*—Joseph J. Hail, III

*Attorney, Agent, or Firm*—Young & Thompson

[57] ABSTRACT

Winding device characterized in that it enables to fabricate coils of which the supports or formers are substantially deprived of rigidity. The device comprises an element (1) for fixing the non-rigid support (2) during the whole winding operation. In order to make said operation possible, an element (4) is axially displaced with respect to the synchronously fed coil and in the same direction as the mechanism of which the arm (5) winds the wire to be wound (3) around the non-rigid support (2), said element (4) having two parts (6 and 7) covering the wound portion on two of its opposite large faces so that the last turn or turns made during fabrication are at least covered on the width of the non-rigid support (2). To prevent the coil from vibrating during manufacturing between the two parts (6 and 7) of the element (4) while the non-rigid support (2) is acted upon by the tension of the wire to be wound (3) of which the direction is turning, there is provided to mount on one of the two parts (6 or 7) of the element (4) a solenoid (8) through which is circulated an electric current thereby forming an electromagnet capable of attracting thereagainst the non-rigid support (2) which is supposedly made with a material sensitive to a magnetic field.

11 Claims, 2 Drawing Sheets

WINDING DEVICE

The present invention has for its object a winding device characterized by the fact that it enables coils to be manufactured by winding a wire around supports which are substantially deprived of rigidity.

The attached drawing shows by way of non limiting example only, several embodiments of the present invention.

Figure 1:
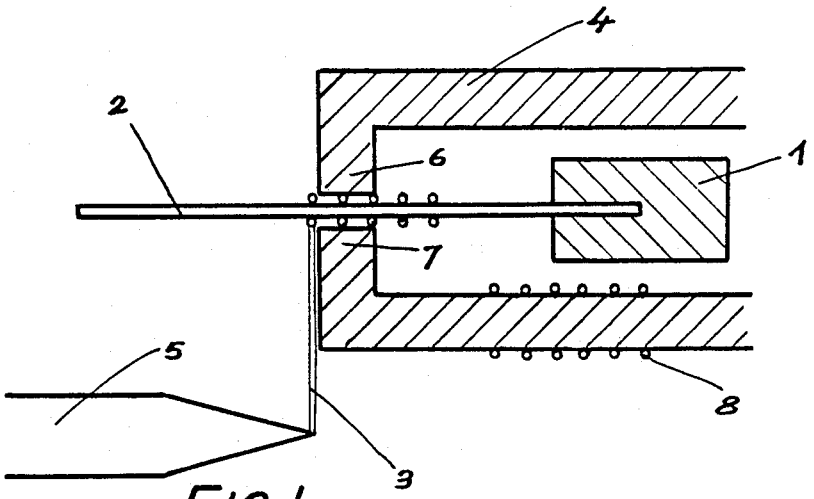
FIG. 1, is a top view in cross-section.
Figure 2:
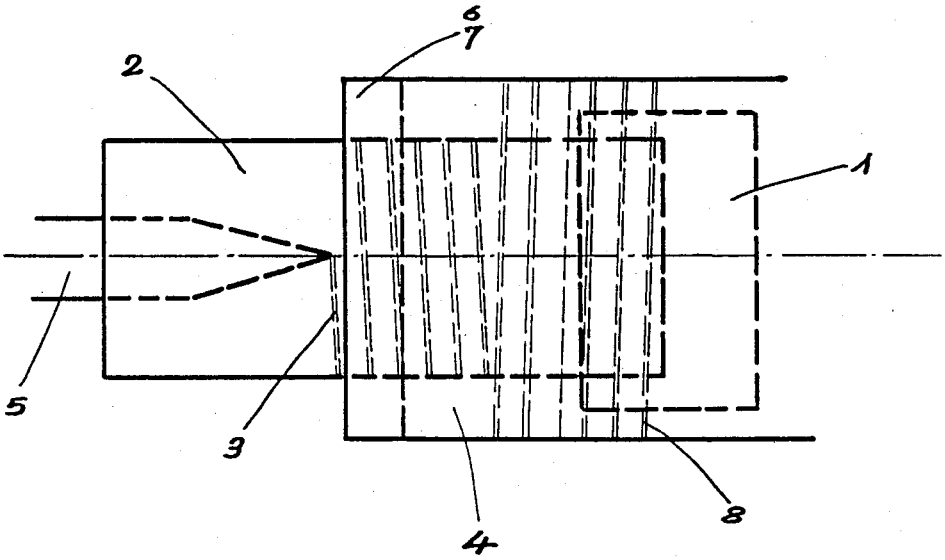
FIG. 2 is a plan view of the device of FIG. 1.

The winding device shown in the drawings comprises an element 1 used as a plier intended to position and then fix the non-rigid support 2 during the winding. The width of this support 2 may be reduced substantially to one approximating that of a thin paper sheet.

In order that the winding operation may proceed, it is necessary that the portion of the non-rigid support 2 which is acted upon by the tension applied to the wire 3 to be wound be rendered non flexible. To this effect, an element 4 is provided positioned axially with respect to the coil the feeding of which is synchronised with the arm 5 of the winding mechanism at each revolution, this feeding being controlled by a motor which is not shown.

The two lateral extensions 6 and 7 of the element 4 are spaced of a distance just greater than the thickness of the non-rigid support 2 plus of twice the diameter of the wire 3 to be wound and covering the wound portion of the wire in such a way that the last wound turns(s) during the manufacture are at least over the width of the non rigid-support 2, this element 4 being therefore able through its two extensions 6, 7 to render sufficiently inflexible the section of the non-rigid support 2 over an extent of the surface of the support is substantially the same as the one of the turn which is just being wound.

During the winding operation and due to the fact that the thickness of the coil is only a little less than the distance separating the two extensions 6, 7 of the element 4 this design enables a free longitudinal displacement of these two extensions 6 and 7 over the portion of the non-rigid support 2 which is already wound. Therefore under these conditions it is possible that the non-rigid support 2, under the tension applied to it by the wire 3 at each revolution may begin to oscillate. To avoid such a drawback, and in case the non-rigid support 2 is made of a material which is sensitive to the magnetic action of a magnet, it may be advantageous to slide over one of the two extensions 6 or 7 of the element 4, a coil 8 conducting an electric current.

Figure 3:
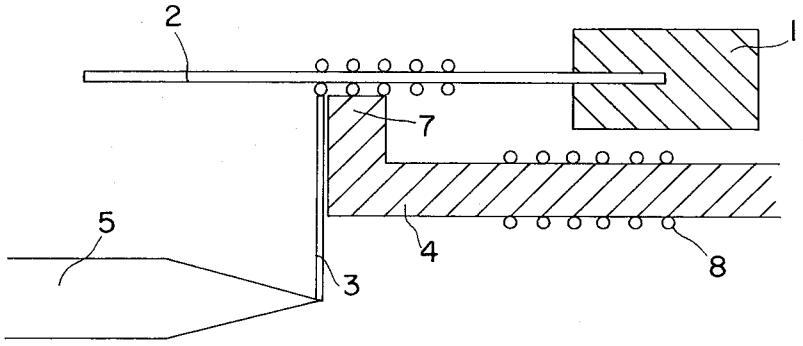
FIG. 3 is a top view in cross-section of a second embodiment of the claimed invention.

In the alternative embodiment depicted in FIG. 3, the element 4 comprises a single member 7 adjacent to which the coil support 2 passes upon having the wire 3 wound therearound. In this alternative embodiment, electromagnetic means is provided in the form of a wire 8 wound around a portion of member 7 which, upon the passage of electric current therethrough, serves to draw the wound coil toward the member 7 and maintain the coil in close proximity to the member.

It is also possible to conduct the winding operation in several ways. For example, the means to wind said wire about the coil support may be maintained in a fixed position while both the coil support and the element 4 are caused to rotate about the winding means to effect the winding of said wire about the support. During such winding an axial movement is also effected between said winding means and said coil support.

We claim:

1. A winding device for winding a wire around a non-rigid planar coil support to form a wound coil which comprises:

means to render substantially non-flexible a portion of a non-rigid planar coil support which is acted upon by tension applied to said wire during said winding of said wire about said support, said means comprising two opposed members having opposed surfaces which are substantially planar in configuration positioned on opposite sides of said non-rigid planar coil support and spaced apart a distance slightly greater than the width of the wound coil, said opposed surfaces being spaced apart sufficiently to permit said coil support to pass therebetween in the form of a wound coil while rendering substantially non-flexible said portion of said coil support between said opposed members;

said opposed members each including a lateral portion extending toward said coil support and a longitudinal portion extending transversely to said lateral portion, said lateral portions of said opposed members including said opposed surfaces serving to render substantially non-flexible said portion of said coil support passing therebetween, means to wind said wire about a portion of said non-rigid coil support adjacent said opposed members;

positioning means to render substantially immobile an end portion of said non-rigid coil support during said winding of said wire upon said coil support, said opposed members being positioned between said positioning means and said winding means; and means to effect axial displacement between said coil support in relation to said opposed members during said winding of said wire.

2. The device of claim 1 wherein said longitudinal portion of one of said opposed members includes electromagnetic means the electromagnetic force of which is sufficient to maintain said wound coil substantially non-flexible during said winding of said wire about said non-rigid support coil.

3. The device of claim 2 wherein said electro-magnetic means comprises a wire coil wound around said longitudinal portion of said one said opposed member.

4. The device of claim 3 wherein said opposed surfaces are substantially rectangular in configuration.

5. The device of claim 1 wherein said means to wind said wire is fixed and both said coil support and said opposed members are adapted to rotate around said means to wind said wire.

6. A winding device for winding a wire around a non-rigid coil support to form a wound coil which comprises:

means to render substantially non-flexible a portion of a non-rigid coil support which is acted upon by tension applied to said wire during said winding of said wire about said support, said means comprising a member positioned on one side and adjacent said non-rigid coil support, said member including a supporting surface for said wound coil;

means to wind said wire about a portion of said non-rigid coil support adjacent said member;

means to axially displace said coil support in relation to said member during said winding of said wire; and wherein said member includes electromagnetic means the electromagnetic force of which is sufficient to maintain said wound coil adjacent said member during said winding of said wire about said non-rigid support coil to maintain said coil support substantially inflexible when adjacent said member.

7. The device of claim 6 wherein said means to wind said wire is fixed and both said coil support and said member are adapted to rotate around said means to wind said wire.

8. The device of claim 6 wherein said supporting surface is substantially planar in configuration.

9. The device of claim 8 wherein said supporting surface is substantially rectangular in configuration.

10. The device of claim 6 further including means to position and render substantially immoblie an end portion of said non-rigid coil support during said winding of said wire upon said coil support.

11. The device of claim 6 wherein said electro-magnetic means comprises a wire coil wound around a portion of said opposed member.

* * * * *